US005727749A

United States Patent [19]

Pensavecchia et al.

[11] Patent Number: 5,727,749

[45] Date of Patent: Mar. 17, 1998

[54] AUTOMATIC PLATE-LOADING CYLINDER WITH CONSTANT CIRCUMFERENTIAL TENSION

[75] Inventors: Frank G. Pensavecchia, Hudson; C. Roth Benson, Candia, both of N.H.

[73] Assignee: Presstek, Inc. Hudson, N.H.

[21] Appl. No.: 597,040

[22] Filed: Feb. 5, 1996

[51] Int. Cl.[6] ..... B41F 27/00

[52] U.S. Cl. ..... 242/538.3

[58] Field of Search ..... 242/538.3; 101/142

[56] References Cited

U.S. PATENT DOCUMENTS

| | | | |
|---|---|---|---|
| 1,760,152 | 5/1930 | Lorentzen . | |
| 2,958,778 | 11/1960 | Miller et al. . | |
| 3,156,182 | 11/1964 | Ritzerfeld et al. . | |
| 3,588,242 | 6/1971 | Berlier et al. | 242/538.3 |
| 3,600,086 | 8/1971 | Cates . | |
| 3,974,974 | 8/1976 | Nishikawa | 242/538.3 |
| 4,076,183 | 2/1978 | Kingsley | 242/538.3 |
| 4,076,410 | 2/1978 | Kono et al. | 242/538.3 |
| 4,231,652 | 11/1980 | Moser et al. | 242/538.3 |
| 4,239,375 | 12/1980 | Eisbein et al. | 242/538.3 |
| 4,477,180 | 10/1984 | Bustamante . | |
| 5,110,699 | 5/1992 | May et al. . | |
| 5,355,795 | 10/1994 | Moss et al. . | |
| 5,413,043 | 5/1995 | Fuhrmann et al. . | |
| 5,435,242 | 7/1995 | Kusch et al. . | |

FOREIGN PATENT DOCUMENTS

| | | |
|---|---|---|
| 0308799 | 9/1988 | European Pat. Off. . |
| 0512549 | 5/1992 | European Pat. Off. . |
| 3009965 | 9/1980 | Germany . |
| 3233021 | 9/1982 | Germany . |
| 3936286 | 11/1989 | Germany . |
| 3936446 | 11/1989 | Germany . |
| 63-295257 | 12/1988 | Japan . |
| 63-295258 | 12/1988 | Japan . |

*Primary Examiner*—John P. Darling

*Attorney, Agent, or Firm*—Cesari and McKenna, LLP

[57] ABSTRACT

An automatic plate-loading cylinder maintains circumferential tension of material wrapped around its exterior surface, the tension being both constant and sufficiently high to keep the material in position against tangential forces (due, for example, to rolling contact with a blanket cylinder). The invention can operate by tying the braking torque exerted on the supply or uptake spool to the radius of that spool, thereby compensating for changes in tension that accompany application of a constant torque. The device can include apparatus for dispensing a consistent amount of material from a supply spool without the need to actually measure the material during a payout cycle. In both aspects, the invention exploits the fact that material is both wound and paid out in an Archimedian spiral. Accordingly, knowledge of an initial radius of one of the spools and the amount of material paid out during each advancement cycle facilitates straightforward computation of the number of necessary rotations of either spool (as well as the resulting new spool radius, which is utilized for the next advancement cycle). The same knowledge additionally allows for straightforward computation of the torque required on the tensioning brake.

16 Claims, 6 Drawing Sheets

AUTOMATIC PLATE-LOADING CYLINDER WITH CONSTANT CIRCUMFERENTIAL TENSION

BACKGROUND OF THE INVENTION

1. Field of the Invention

The present invention relates to digital printing apparatus and methods, and more particularly to an apparatus for continuously supplying lithographic printing material to the plate cylinder of a planographic printing press or a plate imager.

2. Description of the Related Art

Traditional techniques of introducing a printed image onto a recording material include letterpress printing, gravure printing and offset lithography. All of these printing methods require a plate, usually loaded onto a plate cylinder of a rotary press for efficiency, to transfer ink in the pattern of the image. In letterpress printing, the image pattern is represented on the plate in the form of raised areas that accept ink and transfer it onto the recording medium by impression. Gravure printing plates, in contrast, contain series of wells or indentations that accept ink for deposit onto the recording medium; excess ink must be removed from the plate by a doctor blade or similar device prior to contact between the plate and the recording medium.

In the case of offset lithography, the image is present on a plate or mat as a pattern of ink-accepting (oleophilic) and ink-repellent (oleophobic) surface areas. In a dry printing system, the plate is simply inked and the image transferred onto a recording medium; the plate first makes contact with a compliant intermediate surface called a blanket cylinder which, in turn, applies the image to the paper or other copying medium. In typical rotary press systems, the recording medium is attached to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to inking. The fountain solution prevents ink from adhering to the non-image areas, but does not affect the oleophilic character of the image areas.

The plates for an offset printing press are produced photographically or through digital imaging (see, e.g., U.S. Pat. No. 5,339,737). Traditionally, plates have been affixed to the plate cylinders of the press by means of clamps and the like. More recent systems, however, eliminate the chore of removing and replacing spent plates by locating a continuous supply of imageable plate material within the hollow of the plate cylinder. Each time a printing job is completed, fresh plate material is advanced around the cylinder to replace the spent segment. See, e.g., U.S. Pat. Nos. 5,355,795 and 5,435,242.

It is important, during press operation, to maintain a substantial tension along the plate material that surrounds the plate cylinder. This material experiences significant tangential force as a result of contact with the blanket cylinder, the force resulting primarily from, slight differences in the rolling diameters of the mating cylindrical surfaces, which are in contact at sufficient pressure to compress the compliant blanket cylinder surface, and will alter the orientation of the plate or dislodge it completely unless the plate is held with adequate tension against cylinder 12. Accordingly, a plate-material "payout" system must maintain strong contact between the plate material and the cylinder; at the same time, however, it must also allow sufficient relaxation to permit smooth supply and uptake of the material.

Unfortunately, with current systems, tension—even when adequate—tends to vary from job to job as plate material is dispensed from a supply spool and collected on an uptake spool. The reason for this variation stems from the kinds of restraint and braking mechanisms typically employed. The system described in the '795 patent, for example, utilizes a magnetic particle brake associated with the uptake spool. The brake exerts a tensioning drag on the plate material as it is drawn around the cylinder, and the final tension on the wrapped material is determined by the maximum drag torque of the brake.

However, constant drag torque applied to the uptake spool causes the tension actually experienced by the wrapped material to vary inversely with the radius of material accumulated on the uptake spool. As a result, this tension is relatively high during the first printing jobs but decreases as more and more material is wound onto the spool. It has been found that even relatively modest variations in plate tension can have negative effects on press performance. Inadequately low tensions allow the plate material to slip during printing, while excessive tensions can stress or even break the material.

Traditional mechanisms for determining the amount of material to be dispensed during each advancement cycle can also exhibit disadvantages. For example, many material-winding systems utilize metering wheels or other contacting devices to measure material as it is paid out. This type of device is vulnerable to slippage and wear. The timer circuitry described in the '795 patent relies critically on a constant cylinder rotation velocity, which itself assumes highly sensitive control circuitry and considerable rotation torque.

DESCRIPTION OF THE INVENTION

Brief Summary of the Invention

In a first aspect, the present invention concerns means for maintaining a constant tension of material wrapped around a cylinder by an advancement mechanism. In a preferred embodiment, the invention ties the braking torque exerted on the supply or uptake spool to the radius of that spool, thereby compensating for changes in tension that accompany application of a constant torque.

A representative implementation of this embodiment includes a cylinder; rotatable supply and uptake spools within the cylinder, the supply spool dispensing recording material over a travel path extending around the cylinder to the uptake spool; a brake associated with one of the spools; means for restraining backward rotation of that spool; means for restraining rotation of the other spool; and means for controlling the force applied by the brake based on the radius of at least one of the spools so as to a maintain a constant tension around the cylinder.

In a second aspect, the present invention concerns means for dispensing a consistent amount of material from a supply spool without the need to actually measure the material during a payout cycle. The invention exploits the fact that material is both wound and paid out in Archimedian spirals. Accordingly, knowledge of an initial radius of one of the spools and the amount of material paid out during each advancement cycle facilitates straightforward computation of the number of necessary rotations of either spool (as well as the resulting new spool radius, which is utilized for the next advancement cycle).

In a representative implementation, the invention in this aspect comprises a cylinder; rotatable supply and uptake spools within the cylinder, the supply spool dispensing recording material over a travel path extending around the cylinder to the uptake spool; an angular encoder for monitoring rotation of the cylinder; means for winding material onto the uptake spool (e.g., means for rotative force from the cylinder to the uptake spool); and a controller that monitors, directly or indirectly (e.g., by reference to the angular position of the cylinder), the radius of at least one of the spools and, based on these parameters, determines when a predetermined amount of material has been wound onto the uptake spool. At this point, the controller deactivates the winding means.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
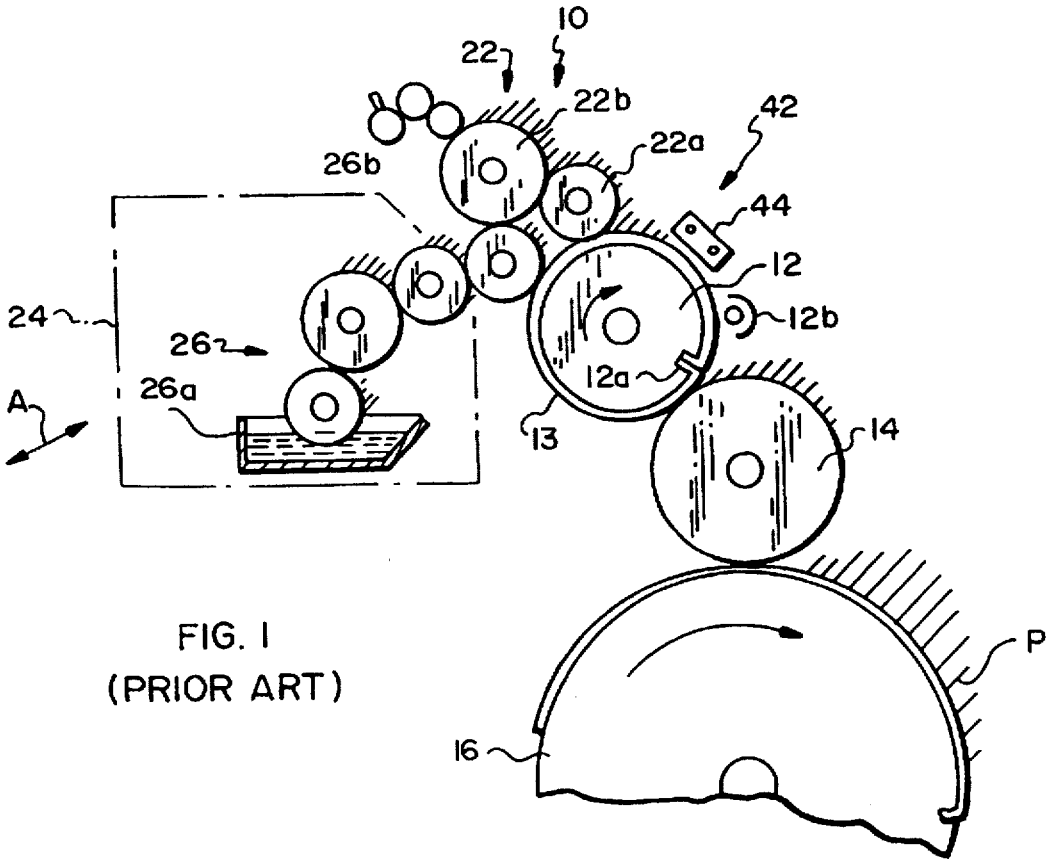
FIG. 1 (PRIOR ART)
FIG. 1 is a partial diagrammatic view of an offset press incorporating a lithographic printing plate made in accordance with this invention.

As noted previously, the invention is useful in conjunction with any type of mechanism that advances sheet or web material around a cylinder. In an exemplary embodiment, the invention is utilized in an on-press imaging environment, such as that illustrated in FIG. 2. As shown therein, plate cylinder 12 is rotatably supported by a press frame 10*a* and rotated by a standard electric motor 34 or other conventional means. The angular position of cylinder 12 is monitored by conventional means such as a shaft encoder 36 and a detector 36*a*; the encoder 36 rotates with the motor armature.

Also supported on frame 10*a* adjacent to plate cylinder 12 is a writing head assembly shown generally at 42. This assembly comprises a lead screw 42*a* whose opposite ends are rotatably supported in the press frame 10*a*, which frame also supports the opposite ends of a guide bar 42*b* spaced parallel to lead screw 42*a*. Mounted for movement along the lead screw and guide bar is a carriage 44. When the lead screw is rotated by a stepper motor 46, carriage 44 is moved axially with respect to plate cylinder 12.

The cylinder drive motor 34 and stepper motor 46 are operated in synchronism by a press controller (not shown), which also receives signals from detector 36*a* so that, as the plate cylinder rotates, the carriage 44 scans axially along the cylinder with the controller "knowing" the instantaneous relative position of the carriage and cylinder at any given moment. The control circuitry required to accomplish this is well known in the scanner and plotter art. Other control circuitry, such as that described in U.S. Pat. No. 4,911,075 (the entire disclosure of which is hereby incorporated by reference), directs the activity of a writing head contained within carriage 44, causing the application at selected points in the scan of imaging pulses (e.g., laser discharges, spark or plasma discharches, or ink jets) directed toward the surface of plate 13. The discharges occur in response to picture signals representing the image to be impressed on the plate, and cause ablation or other surface modification that changes the affinity of the plate for ink and/or water (depending on whether the press is to print in a "dry" or "wet" mode).

Figure 2:
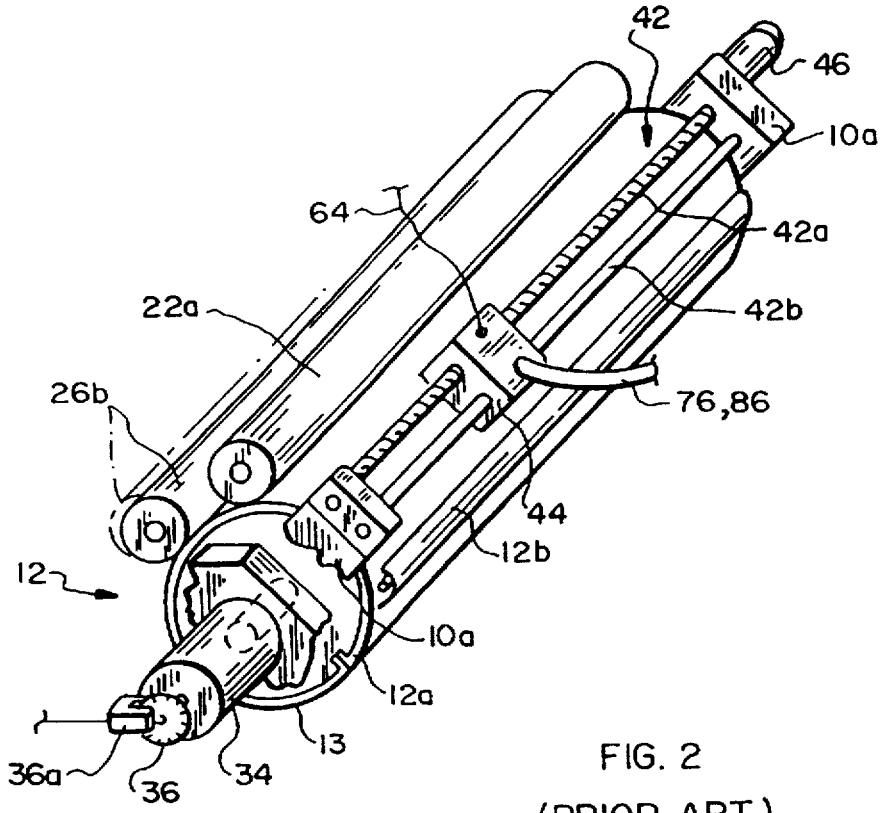
FIG. 2 (PRIOR ART)
FIG. 2 is an isometric view on a larger scale showing in greater detail the plate cylinder portion of the FIG. 1 press.
Figure 3:
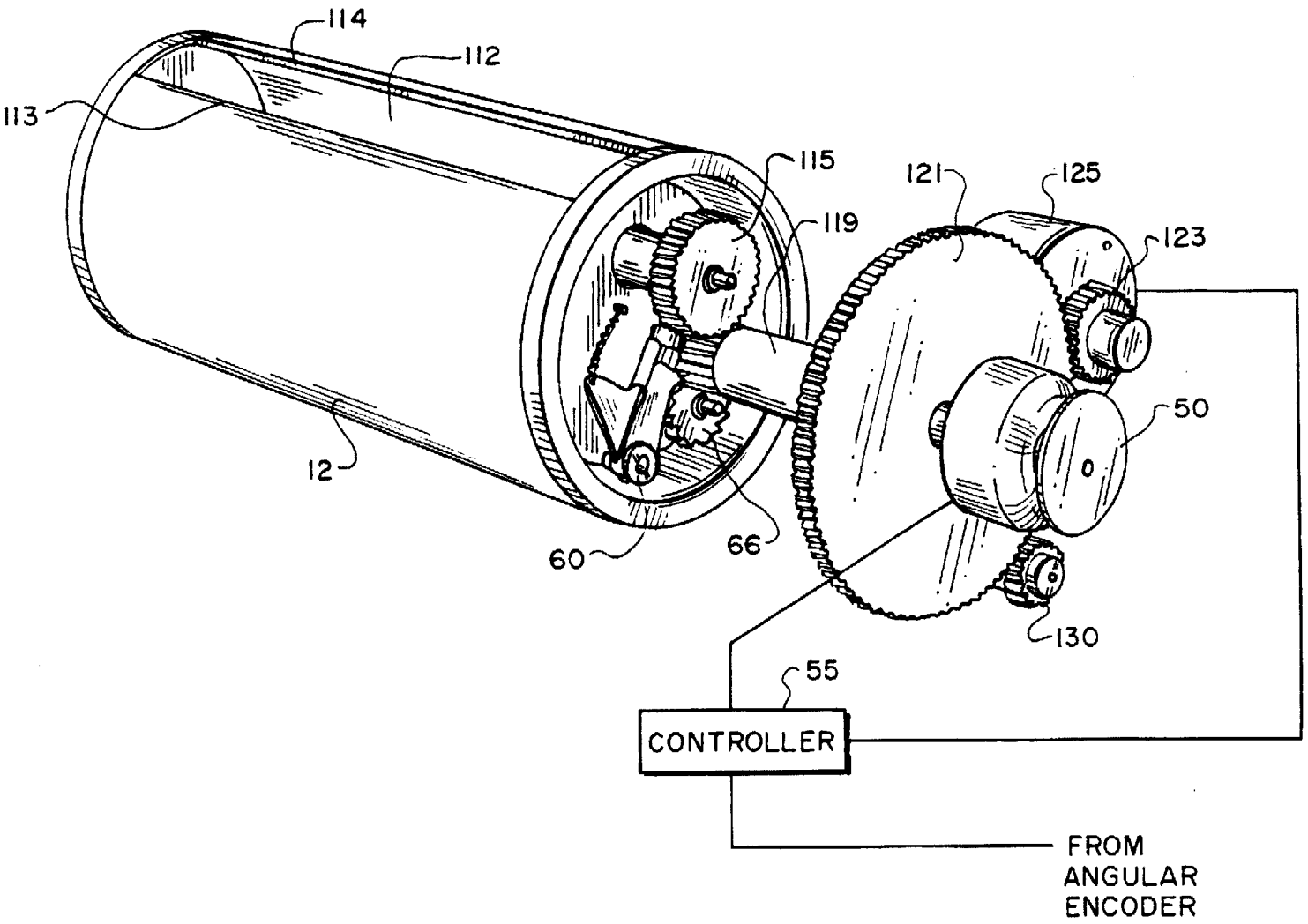
FIG. 3 is an isometric view of the plate cylinder containing the components of the present invention.
Figure 4:
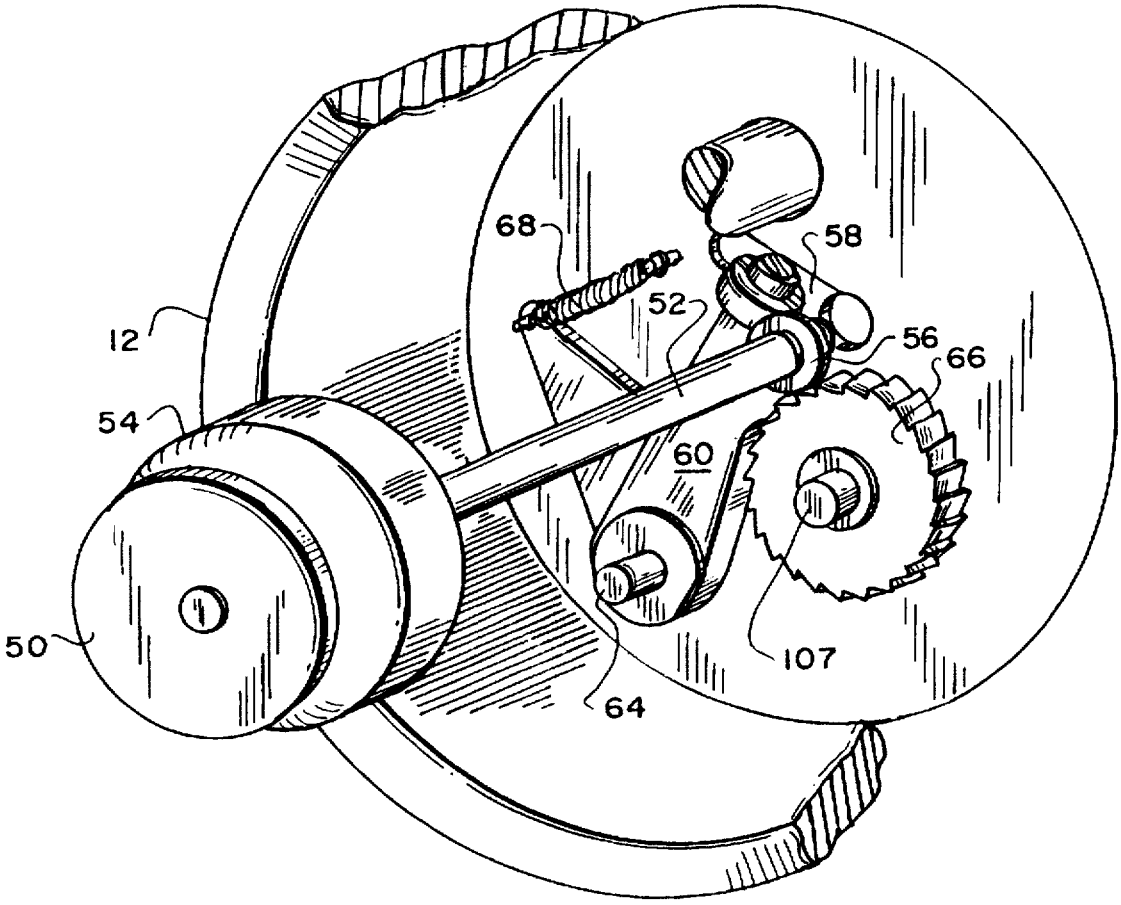
FIG. 4 is a detail of the major components of the supply and locking mechanisms of the present invention.

The present invention provides additional mechanical features that enable the press configuration shown in FIGS. 1 and 2 to accommodate a continuous supply of plate material. Refer now to FIGS. 3 and 4, which illustrate the primary mechanism of the present plate-material supply and uptake apparatus. With particular reference to FIG. 4, a solenoid armature 50 engages a shaft 52 that passes through a solenoid 54 and terminates in a linear cam 56. An internal spring (not shown) urges shaft 52 and armature 50 axially outward from cylinder 12. Cam 56 rests against a linear cam follower 58 such that linear inward movement of armature 50 advances shaft 52 (against the tension of the internal spring) with consequent radial displacement of cam follower 58. The necessary movement of armature 50 may be accomplished manually or, in the preferred embodiment, by electrical activation of solenoid 54, which retains shaft 52 in its shifted position. Solenoid 54 is also connected to a controller 55, which, as described below, determines when an advancement cycle has been completed and deactivates and disengages solenoid 54 at that time.

Cam follower 58 extends from a pawl 60, which rotates on a pivot 64. The tooth of pawl 60 engages a ratchet 66 (whose function is described below). A pawl spring 68, extending between the arm of pawl 60 and a point within plate cylinder 12 that remains stationary with respect to pawl 60, urges pawl 60 against ratchet 66. Accordingly, the displacement of cam follower 58 caused by linear movement of shaft 52 and cam 56 counteracts the action of spring 68, releasing pawl 60 from engagement with ratchet 66.

Figure 5:
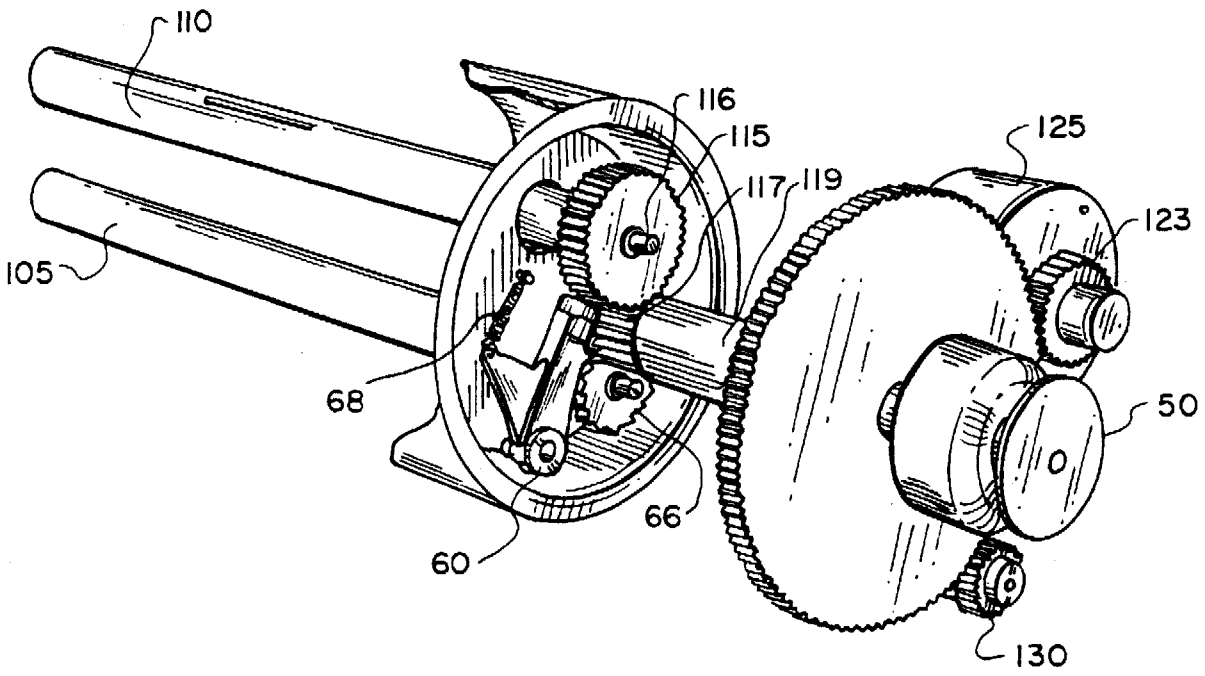
FIG. 5 is an isometric view of supply and uptake spools for dispensing plate material around the plate cylinder, shown in conjunction with the major components of the present invention.

Refer now to FIG. 5, which illustrates the mechanism by which plate material is released and taken up. That mechanism may be packaged as a removable, replaceable cassette, as discussed in the '795 patent, or, more preferably, utilizes individual supply and uptake spools that may be introduced into and withdrawn from the body of cylinder 12. In either case, a plate-material supply spool 105 is coupled to the shaft 107 of ratchet 66 (see FIG. 4), and a plate material uptake spool 110 that engages gear 115 and its integral shaft 116. Thus, when pawl 60 disengages ratchet 66, supply spool 105 is free to rotate and dispense fresh plate material.

During operation, plate material from supply spool 105 emerges from a space or gap 112 in cylinder 12, passing across a first edge 113 of the gap and wrapping around cylinder 12, then re-entering the body of cylinder 12 over the opposed edge 114 of gap 112 onto uptake spool 110. Also as shown in FIG. 5, uptake spool 110 is coupled to an uptake gear 115 by means of integral shaft 116. Uptake gear 115 meshes with a shaft gear 117 coaxial with linear cam shaft 52; shaft gear 117, not shown in FIG. 4 for clarity of presentation, resides just behind cam 56. As shown in FIGS. 3 and 5, shaft 52 is surrounded by a sleeve 119, which contains the internal spring mentioned above, and is also secured to a large gear 121. Gear 121 meshes with a brake gear 123, which extends from an electrically controlled brake 125.

Operation of the plate-winding mechanism of the present invention may be understood with continued reference to FIGS. 3–5. Ordinarily, shaft 52 rotates with cylinder 12 and gear 115 remains stationary with respect to shaft 52; gear 121 rotates with respect to gear 123, which offers no resistance thereto. Axial movement of solenoid armature 50 and shaft 52 (which are preferably isolated mechanically from shaft 52 so as to remain conveniently stationary) results in disengagement of pawl 60 and consequent release of supply spool 105, as described above, as well as signaling controller 55 to engage brake 125. With brake 125 engaged, rotation of shaft 52 and shaft gear 117 is arrested. Cylinder 12 continues to rotate, however, and with shaft gear 117 now rendered stationary, rotation of of cylinder 12 causes uptake gear 115 to rotate about shaft gear 117 as a "planet" gear, turning uptake spool 110 to draw plate material from supply spool 105 (itself now free to rotate due to disengagement of pawl 60). Reverse rotation of uptake spool 110 is prevented as discussed below.

Figure 6:
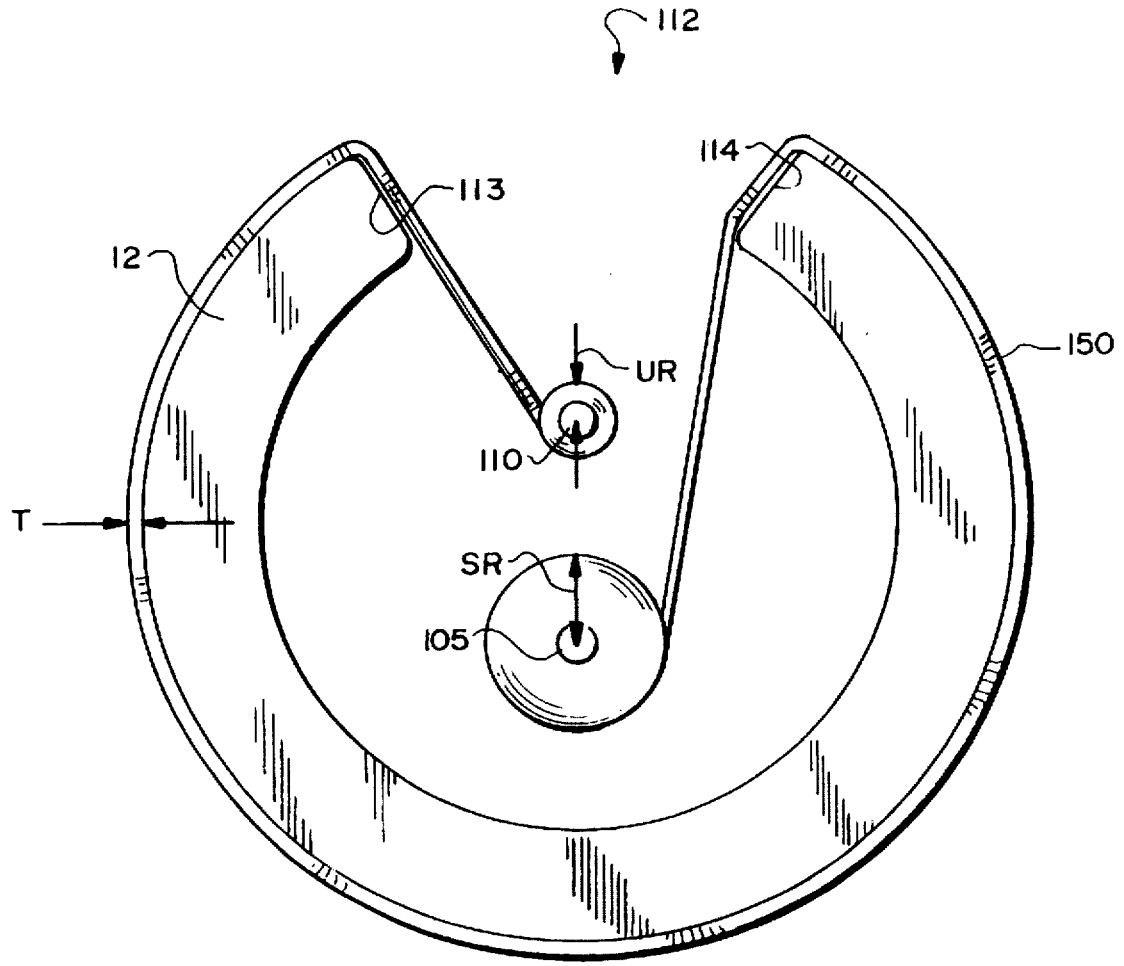
FIG. 6 is a schematic end view of a cylinder incorporating the present invention, showing how the number of cylinder rotations needed to fully advance the plate material, as well as the brake torque needed to retain constant tension, are computed.

Refer to FIG. 6, which schematically illustrates the parameters upon which braking torque and material payout are based; thicknesses in the figure are exaggerated for purposes of presentation. The material 150 extends from supply spool 105 through gap 112, over edge 114 and around cylinder 12, then to uptake spool 110 through gap 112 over edge 113. Material winds off spool 105 and onto spool 110 in Archimedian spirals. At any particular point during use, spool 105 plus material surrounding it have a radius SR, while spool 110 plus material surrounding it have a radius UR. The material 150 has a thickness T, and is advanced, during each cycle, a linear distance AD. This distance may be, for example, the circumferential distance around cylinder 12 from edge 113 to edge 114; more generally, however, AD corresponds to the length of the region actually utilized for imaging plus a gap.

The change in the radius UR over an advancement cycle is given by:

$$UR(\text{new})=[([AD][T]/\pi)+UR(\text{old})^2]^{1/2}$$

The change in the radius SR over an advancement cycle is given by:

$$SR(\text{new})=[SR(\text{old})^2-([AD][T]/\pi)]^{1/2}$$

Either of these equations can be used to determine the number of revolutions of uptake spool 110 or supply spool 105 necessary to pay out a full length AD of new material according to the following equations:

$$\text{Number of spool revolutions}=[R(\text{new})-R(\text{old})]/T$$

where R is UR, and $$\text{Number of spool revolutions}=[R(\text{old})-R(\text{new})]/T$$

where R is SR.

The number of spool revolutions is related, in turn, to the number of necessary revolutions of cylinder 12 by the gear ratio between the cylinder rotation and the rotation of the selected spool. In practice, it is the radius of the uptake spool 110 that is typically used to perform these computations. In an exemplary embodiment, the necessary number of cylinder revolutions is twice the number of uptake spool revolutions. Controller 55 stores the current radius (e.g., UR), computes the number of necessary cylinder rotations and also the new radius UR that will result from the advancement cycle. The computed new radius UR is used as R(old) during the next advancement cycle.

Angular encoder 36, whose output is coupled to controller 55, allows controller 55 to monitor rotation of cylinder 12. When cylinder 12 has rotated, with shaft gear 117 stationary, a sufficient number of times to withdraw a length AD of plate material from supply spool 105, controller 55 deactivates solenoid 54, resulting in re-engagement of pawl 60 and ratchet 66 and consequent locking of supply spool 105. Brake 125, however, remains active, preventing rotation of gears 121 and 117, so that uptake gear 115 continues to turn about shaft gear 117 as cylinder 12 rotates. As additional plate material is wound onto uptake spool 110, the tension in the plate material along the exterior of cylinder 12 increases. This augments the torque on gear 121 and, consequently, on brake 125 as well. When the maximum allowed torque on brake 125 (computed as discussed below) is exceeded, brake 125 slips and gear 121 begins to rotate. This results in cutoff of power to brake 125. Unimpeded by brake 125, shaft 52 is then free once again to rotate. The tension established along the plate material is maintained by the one-way clutch (which prevents material from leaving uptake spool 110) and ratchet 66 and pawl 60 (which prevent material from being drawn off supply spool 105).

It is not necessary to immediately detect the point at which brake 125 slips. Since some rotation of gear 123 past the point of brake slippage is harmless, a simple timing circuit (tied, for example, to engagement of solenoid 50) can be used to cut power to brake 125 when it can be safely assumed that it has slipped. Alternatively, if more precision is desired, a detector gear 130 can be utilized; this gear meshes with gear 121 and is also coupled to a resettable relay that cuts power to brake 125 as soon as gear 130 begins to rotate, reflecting slippage of brake 125.

The torque r on brake 125 is given by the cross-product $$\tau=r\times F,$$

where r is the radius vector corresponding to UR and F is the tensioning force around cylinder 12. Thus, if torque is held constant, F will increase as UR decreases. To maintain a constant tension F, therefore, the torque must be set at a level adequate to accommodate the initial radius of a full supply spool 105, and decrease stepwise following each advancement cycle to reflect the reduction in UR. This is straightforwardly accomplished with a magnetic particle brake, since the applied torque is, for the most part, linearly related to the applied current, the magnitude of which is controlled by controller 55. The functions of controller 55 are straightforwardly implemented on a programmable digital computer without undue experimentation by one of routine skill in the art. Indeed, even if the response of brake 125 with respect to current departs from linearity, it is readily modeled computationally by controller 55, which delivers the appropriate current to obtain the necessary torque.

Figure 7:
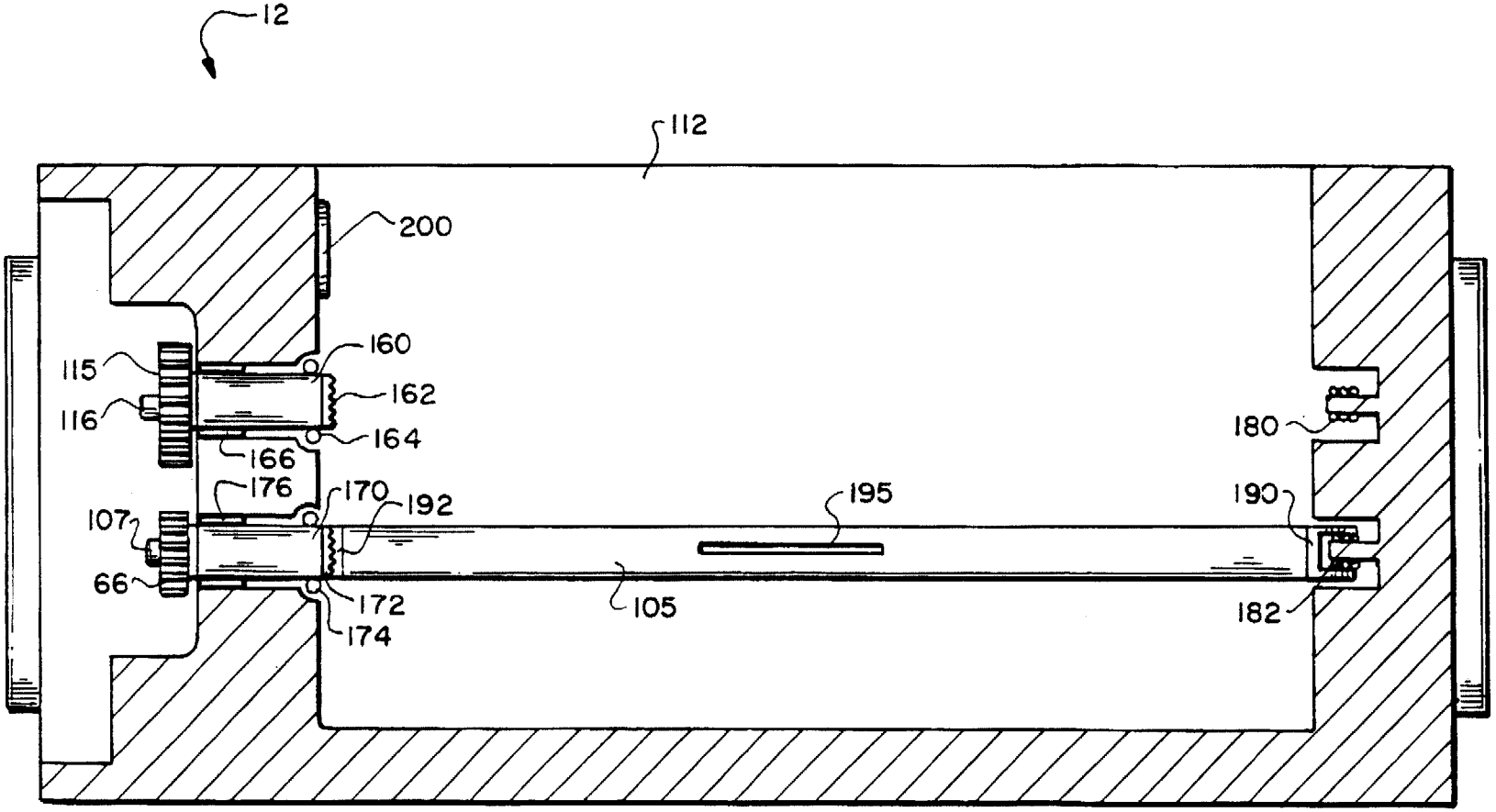
FIG. 7 is a cutaway elevational view of a plate cylinder incorporating the present invention, with some drive components omitted for clarity.

As indicated earlier, the supply and uptake spools can be mounted within cylinder 12 in any number of suitable manners. A preferred engagement scheme is illustrated in FIG. 7, which permits spools 105, 110, unhoused in a cassette or other frame, to be selectably engaged with (or withdrawn from) the drive components of the present invention. This arrangement straightforwardly permits monitoring of either or both radii UR and SR. Shaft 116 widens into a connecting shaft 160, terminating in a toothed engagement gear or coupling 162. Shaft 160 rotates on a journal bearing 164. A one-way roller or shell clutch 166 prevents reverse rotation of shaft 160. Similarly, a connecting shaft 170 extends from ratchet 66 and terminates in a toothed coupling 172. Shaft 170 rotates on a journal bearing 174, and, if desired, may be surrounded by a one-way roller clutch 176.

Spools 105, 110 engage shafts 160, 170 by means of toothed couplings complementary to couplings 162, 172. The opposite ends of spools 105, 110 each rotate on a journal bearing 180, 182. Spools 105, 110 are introduced into cylinder 12 by retracting shafts 160, 170; when the spools are properly oriented, with their ends engaging journal bearings 180, 182, shafts 160, 170 are extended to engage the spools.

An exemplary form of spool is shown in the figure as a supply spool 105; in operation, a similar spool would serve as an uptake spool, engaging coupling 162 and bearing 180. The illustrated spool 105 comprises a hollow, elongated, cylindrical roller that includes a concave engagement member 190 at one end and a toothed coupling 192 at the opposite end.

Spool 105 is formed of a heavy-duty, dimensionally stable material, such as stainless steel, that can endure the substantial torque and other forces resulting from the printing process without bending, compressing or otherwise changing in shape. Spool 105 includes a longitudinal slot 195, which, when the spool is used for uptake, accepts an edge of the plate material drawn from the supply spool and around cylinder 12. A supply spool has a predetermined amount of plate material wound therearound, and formed into a tab at the free end. The tab fits within slot 195 of uptake spool 110. The outer surface of the spool is preferably rough in order to promote retention of the material during uptake, and the plate material itself should be flexible enough to tolerate unrolling and winding; ideally, the material retains a crease formed when the tab is inserted into slot 195, further limiting any tendency toward slippage.

The full supply spool 105 and an empty uptake spool 110 can be lowered into place and secured sequentially, or simultaneously using a gripping and alignment tool as described in U.S. Ser. No. 08/435,094 (filed May 4, 1995 and entitled REMOVABLE SUPPLY AND UPTAKE ASSEMBLIES FOR LITHOGRAPHIC PLATE MATERIAL), the entire disclosure of which is hereby incorporated by reference.

In practice, since the supply spool 105 is packaged with a standard amount of plate material wrapped therearound, its initial radius SR is known; in addition, the amount of material withdrawn in order to adequately engage it to uptake spool 110 is also known, as is the number of turns onto spool 110 in order to complete the engagement. Accordingly, it is possible to compute braking torque and the number of cylinder rotations necessary for advancement without actually measuring either quantity UR or SR, since the initial values are known and subsequent values may be calculated.

Nonetheless, one can obtain more precise measurements of, for example, UR using an optical sensor 200 coupled to controller 55.

It is also possible to add precision to the manner in which plate material is dispensed. As noted earlier, the amount of material actually paid out during a cycle is equal to the length of the area to be imaged plus a gap. Ordinarily it is necessary to allow a gap of at least about 0.5 inch to ensure that the new image will not overlap the old image due. For example, some material may be wound by uptake spool 110 before any material is actually drawn from supply spool 105; unless slightly more material is taken up than would be necessary in a system devoid of slackness, the result could be insufficient payout. To avoid the need for this additional material, means can be introduced to monitor supply spool 105, material wrapped therearound, or shaft 107 to detect the onset of rotation (and actual payout), when it is appropriate to begin monitoring the rotation of cylinder 12—i.e., when the advancement cycle truly commences. This detection means can be, for example, a gear on shaft 107 or a spring-loaded rubber wheel riding on the surface of the undispensed plate material, which is configured to signal controller 55 as soon as it begins to turn.

It will therefore be seen that we have developed a reliable and convenient mechanism for dispensing and receiving material that wraps around a cylinder, and which is especially suited to lithographic printing systems. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. Apparatus for winding a recording material onto a cylinder adapted for rotation about a longitudinal axis, the apparatus comprising:

a. a cylinder;

b. first and second rotatable spools within the cylinder, the first spool being configured to dispense a rolled supply of recording material over a travel path extending around the cylinder to the second spool, the second spool being configured to permit winding of dispensed recording material therearound, each spool having a radius including the spool and material wound therearound;

c. means for winding material onto the second spool;

d. control means for causing a predetermined amount of material to be dispensed from the first spool and wound onto the second spool, the control means activating the winding means to begin dispensing material and, based on a determined radius of at least one of the spools and rotation thereof, deactivating the winding means after the predetermined mount of material has been dispensed.

2. The apparatus of claim 1 wherein the winding means comprises means for coupling movement of the recording material along the path to rotation of the cylinder.

3. The apparatus of claim 2 further comprising means for sensing an angular position of the cylinder, and wherein the winding means causes rotation of the cylinder to rotate the second spool and the control means deactivates the winding means based also on the sensed angular position of the cylinder.

4. The apparatus of claim 2 wherein the winding means is a motor that rotates the second spool.

5. The apparatus of claim 1 wherein, when the winding means is activated, the second spool has an initial radius and the control means deactivates the winding means when the second spool has a final radius corresponding to uptake of a predetermined amount of material.

6. The apparatus of claim 5 further comprising means for sensing an angular position of the cylinder, and wherein the winding means comprises means for coupling movement of the recording material along the path to rotation of the cylinder and the control means determines the radius of the second spool based on the sensed angular position of the cylinder.

7. The apparatus of claim 1 further comprising means for maintaining a constant tension of material around the cylinder, said means comprising:

a. a brake for restraining rotation of the first spool;

b. means for controlling the force applied by the brake based on the radius of at least one of the spools; and c. means for restraining backward rotation of the second spool.

8. The apparatus of claim 7 wherein the means for restraining backward rotation of the second spool comprises a one-way clutch.

9. The apparatus of claim 7 further comprising mechanical locking means for restraining rotation of the first spool.

10. The apparatus of claim 7 wherein the force applied by the brake is based on the radius of the second spool.

11. Apparatus for winding a recording material onto a cylinder adapted for rotation about a longitudinal axis, the apparatus comprising:

a. a cylinder;

b. first and second rotatable spools within the cylinder, the first spool being configured to dispense a rolled supply of recording material over a travel path extending around the cylinder to the second spool, the second spool being configured to permit winding of dispensed recording material therearound, each spool having a radius including the spool and material wound therearound;

c. a brake associated with one of the spools;

d. means for restraining backward rotation of the other spool;

e. means for controlling the force applied by the brake based on the radius of at least one of the spools so as to a maintain a constant tension around the cylinder.

12. The apparatus of claim 11 wherein the means for restraining backward rotation of the other spool comprises a one-way clutch.

13. The apparatus of claim 11 further comprising mechanical locking means for restraining rotation of the spool associated with the brake.

14. The apparatus of claim 11 wherein the force applied by the brake is based on the radius of the other spool.

15. The apparatus of claim 11 further comprising a one-way clutch associated with the spool associated with the brake.

16. The apparatus of claim 11 wherein the brake is associated with the second spool.

* * * * *